United States Patent [19]

Jacobson et al.

[11] 4,036,361

[45] July 19, 1977

[54] COLLAPSIBLE CONTAINER

[76] Inventors: Leo Jacobson, 59 Cathay Road; Wallace Forman, 66 Newkirk Ave., both of East Rockaway, N.Y. 11518

[21] Appl. No.: 642,119

[22] Filed: Dec. 18, 1975

[51] Int. Cl.[2] ..... B65D 19/00

[52] U.S. Cl. ..... 206/386; 150/1; 220/6; 280/78

[58] Field of Search ..... 108/55.1; 150/1; 206/386; 141/10, 1, 378, 114; 220/6; 280/78

[56] References Cited

U.S. PATENT DOCUMENTS

| | | | |
|---|---|---|---|
| 2,696,360 | 12/1954 | Toffolon | 206/386 |
| 3,319,684 | 5/1967 | Calhoun | 150/1 |
| 3,366,231 | 1/1968 | Trakas | 206/386 |

*Primary Examiner*—Houston S. Bell, Jr.
*Attorney, Agent, or Firm*—Morgan, Finnegan, Pine, Foley & Lee

[57] ABSTRACT

The present invention concerns a collapsible containing device for bulk transport and storage of liquid and solid cargo and is characterized as having as its primary containing means a flexible, high strength bag or sleeve capable of collapsing within its supporting frame to a compact configuration.

16 Claims, 4 Drawing Figures

COLLAPSIBLE CONTAINER

BACKGROUND OF THE INVENTION

The present invention relates to a collapsible container for purposes of storing and transporting large quantities of liquid and solid materials. The transportation system in the United States and throughout the world is heavily overloaded with the transporting of various types of cargo by road, rail, sea and air. Such movement of goods has long been dependent upon the type of containers used to carry the materials. An important problem which always accompanies the transporting of cargo is the storage and return of the empty cargo containers to the origin site for purposes of refilling and re-use. As a result of this problem much investigation has been done over the years to improve such containers to maximize their efficiency and improve utilization of warehouse and transportation space.

The earliest major transporting and storage device was the barrel or large tank. These devices were generally made of wood and metal materials. With the advent of high strength plastic materials, molded containers became a welcome addition in the container industry. As plastic containers are less expensive than the containers previously used, they are often considered disposable items which can be eliminated upon being emptied.

A recent breakthrough in the transporting of cargo is the mass containerization used primarily in transporting cargo in great volume. However, there is little advantage in using this technique in moving smaller quantities of cargo than can fill a large shipping container such as the size of a railroad freight car. Moreover, even the large, self-contained vessel comprises smaller receptacles which again are either disposable or must be reshipped for refilling.

The present invention is directed to a container which is collapsible when empty for ease of storage when not in use and for efficient retransporting to the origin site for refilling. Although it is collapsible, it is of high strength and can support and contain large quantities of heavy, cumbersome materials. Moreover, the collapsible container of the present invention has been specially adapted with various features which render it particularly efficient and reliable in the transporting and storage of materials.

Collapsible containers have heretofore been the subject of much investigation for various end uses. For example, in U.S. Pat. No. 2,767,757 issued to Marder a collapsible container with supporting frame is described which is adapted for use as a laundry hamper, wastebasket or like container. This receptacle is not adapted for supporting large and heavy quantities of materials nor does it have means for completely enclosing or sealing its contents. It is not designed for withstanding the abuse which would be incident to its use as a shipping container. The collapsible bag is formed of a flexible fabric material but is only attached to the frame at the top. Such a construction does not relate to the collapsible container of the present invention.

Other devices have been suggested and described which have the ability to be collapsed or reduced in size when empty yet be used for storing and transporting materials. U.S. Pat. No. 2,837,860 issued to Norling, describes a collapsible bucket which comprises a tight canvas bag having a circular bottom reinforced by a galvanized steel ring. Again, this type of a construction does not lend itself to withstand handling during transportation nor in fact was it intended for such use as is clear from the flexible bag which is of a water permeable canvas material.

It has been suggested to use a collapsible container which comprises a flexible fabric material in the transporting and storage of large quantities of materials including liquid cargo. However, when such a container has been suggested, it has required a very sophisticated and complicated construction in the supporting metal frames to enable it to carry and hold with relatively heavy and cumbersome materials. This may be illustrated in U.S. Pat. No. 2,623,565 issued to Unthank. The collapsible tank in the Unthank patent is described as suitable for transporting liquid cargo in bulk. The tank walls are of a flexible material such as a fabric-reinforced, liquid-proof material which forms sidewalls which are capable of being folded into a plurality of superimposed pleats upon being collapsed. The material is anchored to the frame at the outer fold of each of the pleats.

Of particular significance in the tank described in the Unthank patent is that the tank has not been designed for easy transporting as, for example, the tank is designed to be at least temporarily and probably permanently secured to or fixed to the floor of a ship wherein the tanks are transported. Moreover, the frame of the tank has a very costly and intricate construction which is necessary for the method in which that tank collapses. For example, the tank of Unthank comprises some nine or more steel tubes with intricate linking plates, hinges, collars and clamping plates to enable the fabric sidewalls to fold at the pleats, to follow the contour of the linking plates upon being collapsed. The device of Unthank is not believed designed for handling in transporting. Also, if a defect occurs in the bag because of the intricate means of attachment to the supporting frame, it would be a costly component to replace.

Still another suggestion for a collapsible transporting device is that described in U.S. Pat. No. 1,507,977 issued to Schaefer. This patent merely describes a bag which is suspended within a collapsible crate. This shipping crate specifically is adapted for transporting perishable fruit where the bag is utilized for protection of the fruit and not as the primary containing means.

SUMMARY OF THE INVENTION

This invention relates to a new collapsible containing device for the transportation of and storage of liquid and solid cargo. This device is conducive with and may be used in conjunction with conventional barrels, tanks and drums presently employed in shipping or storage warehouse systems. However, the collapsible containing devices of the present invention overcome many of the disadvantages which exist with such prior, conventional containers.

It has now been discovered that a collapsible containing device can be constructed which can be collapsed to as small as 25% or less of its fully opened volumetric size yet still have adequate strength and reliability when full with cargo to be used in both manual and mechanized transporting systems. Additionally, the collapsible containing device of the present invention fully utilizes warehouse and carrier space when full and is easy to move and handle by both manual and mechanical means.

Additionally it has been discovered that a collapsible containing device can be constructed which comprises as its primary containing means a flexible material in the form of a bag or sleeve which is attached to a supporting collapsible frame. The combination of the specially adapted flexible material and its means of attachment to the collapsible frame enable it to support and contain heavy and cumbersome materials both in liquid and in solid form. The collapsible frame has the ability to withstand the great weights of contained material yet can be easily collapsed into a compact configuration when the container is empty.

Accordingly, the present invention has the following objects:

It is an object of the present invention to provide a collapsible containing device which is capable of being used in combination with conventional drums, barrels or tanks in a single system of bulk storage and transportation of cargo yet obtain the advantages of the device of the present invention.

It is another object of the present invention to provide a collapsible containing device for holding cargoes which maximizes the use of storage and carrier space both in open and collapsed configurations yet can be easily handled and moved by both manual and mechanical means.

It is a further object of the present invention to provide a collapsible containing device for carrying large quantities of both liquid and solid cargo which devices are collapsible when not in use, significantly reducing the space which it takes up in a shipping carrier or storage warehouse, yet be strong and reliable as a containg device.

It is an additional object of the present invention to provide a method or system of transporting large quantities of liquid and solid cargo by means of containing devices each of which conform with conventional standard size, but which can be adapted for use in larger containerization techniques and which can be easily stacked and inter-connected to allow transport and storage of more than one individual device in a unitary construction.

Other objects and advantages of the invention will be set forth in part hereinafter and in part will be obvious herefrom or may be learned by practice with the invention.

BRIEF DESCRIPTION OF THE DRAWINGS

The invention will be better understood when considered with the following drawings herein.

DESCRIPTION OF THE PREFERRED EMBODIMENTS

According to the present invention, there is provided a collapsible containing device with means for sealing its contents from leakage. The device is characterized as comprising a specially adapted flexible bag or sleeve component for containing both liquid and solid flowable materials, wherein said bag or sleeve component is secured at its top and bottom to the upper and lower plates of a supporting frame which comprises an upper and lower plate connected by vertical leg members attached to each of the plates by hinge means suitably located along the perimeter of each of the plates. The leg members are movable through the hinge means into two positions, a locked, expanded position where they form vertical supports for the bag or sleeve component for receiving and containing cargo and a closed or collapsed position where the upper and lower plates are substantially adjacent to one another and the leg members are substantially collapsed and compacted within the space provided by the plates themselves. Where the upper and lower plates are not circular in shape, they are each adapted to receive a circular transporting rim or ring attachable at the corners of each plate to enable said containing device to be rolled along the ground.

Another aspect or feature of the present invention is a method or system of bulk transporting liquid and solid cargo by utilizing the above-described collapsible containing device.

Supporting Frame Component

The supporting frame component comprises an upper and lower plate attached to each other by vertical leg members. The leg members are attached to the plates by hinge or closing means located along the perimeter of each of the plates. The actual means of attaching the leg members to each of the plates will depend upon the particular means chosen for causing the leg members to collapse.

Figure 1:
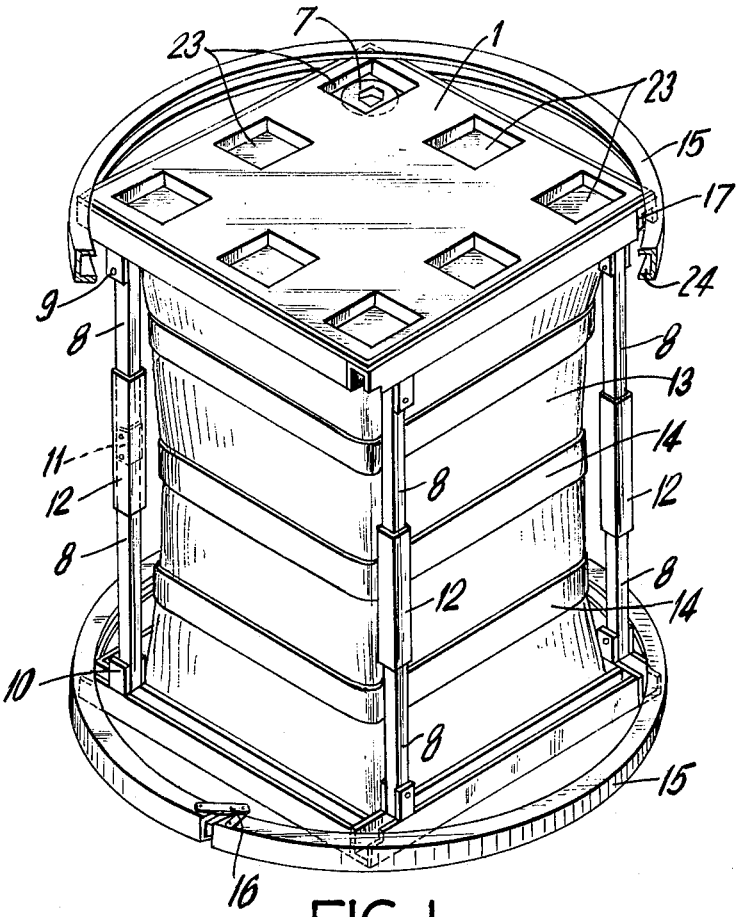
FIG. 1 is a perspective, cross-sectional view of the containing device in expanded, fully opened position, constructed in accordance with the present invention, wherein the device is featured with transporting rings.

FIG. 1 describes one embodiment of the present invention where a containing device is fully open yet is not filled with cargo. The upper plate 1 is attached to the lower plate 2 by four leg members 8 each having three hinges 9, 10 and 11. There is one hinge attaching each leg member to each of the two plates and a third median hinge 11 at a point along the leg member between the two plates preferably equidistant between the plates, which allows the leg in collapsed position to fold into two pieces at that point. A lock sleeve 12 is provided to cover the median hinge and thereby immobilize it to lock the leg in the opened, vertical position. The lock sleeve surrounds part of the length of each leg member and is capable of moving up and down the length of the leg. Other stops may be present to maintain the sleeve lock in the position over the median hinge.

Figure 2:
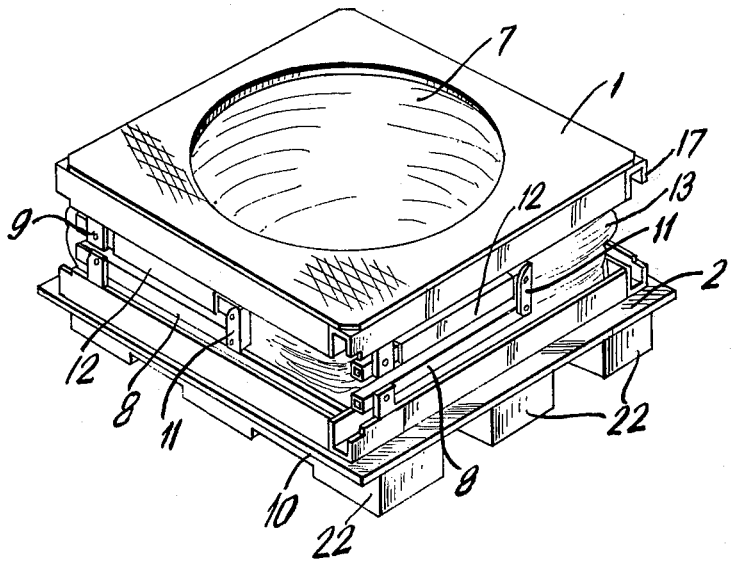
FIG. 2 is a perspective view of the containing device of FIG. 1 in the collapsed position.

FIG. 2 illustrates a containing device of the present invention in the collapsed or compact configuration. As can be seen, the upper plate 1 is substantially adjacent to the lower plate 2. Where the leg members are designed to collapse substantially in the space or recess provided within the plates themselves, the plates may actually abut one another in the collapsed position. However, in an embodiment such as is illustrated in FIG. 2, in the collapsed position, the plates may be spaced apart by a distance of as much as twice the diameter of the leg members.

Another embodiment of the present invention would include legs which are telescopic in that they comprise a plurality of pieces of different diameter which when collapsed one piece falls within the adjacent larger piece. The choice of the particular means of causing the leg members to reduce in size or vertical length is not critical so long as the leg members maintain their rigidity when in the open position yet when collapsed they sufficiently reduce in size so that the upper and lower plates become substantially adjacent to one another.

The leg members may have any suitable diameter and dimension which is sufficient to render them strong enough to support the weight of the containing device when filled. Tubular legs as well as solid legs are contemplated. Preferably the legs should be strong and lightweight.

The leg members in addition to being collapsible as described above, may also be adapted to maintain their rigidity at different, adjustable lengths. Having leg members which have adjustable length capability allows the collapsible containing device to be used for various volumetric capacities. The leg members must be sufficiently long to fixedly position the upper plate in sufficiently elevated relation above the base plate to permit the flexible support member to be taut.

The capacity of the containing device can be conventional in size. For example, conventional tanks or barrels used in bulk transporting and storing liquids have sizes that range from 55 gallons downward. A 55 gallon tank generally contains about 50 gallons of cargo. The additional volume allows for expansions and contraction of the cargo material. A typical containing device of the present invention having a 55 gallon capacity would have outside dimensions of about 24 inches × 24 inches × 29 ½ inches. When collapsed, such a device would reduce to about one-fifth its open volumetric size.

The Upper and Lower Plates of the Frame

The upper and lower plates must be of a high strength material. The containing device of the present invention can be capable of being stacked one upon another to most fully utilize available warehouse and carrier space.

The upper and lower plates can be adapted with various features depending upon the particular purposes of use of the containing device.

The upper plate contains a closable opening or hole for filling and emptying the containing device. The size of the opening will depend upon the nature of the cargo.

For example, a container carrying dry cargo materials may require a large opening 7 such as is illustrated in FIG. 2. For liquid cargo a smaller opening such as is illustrated in the other figures is preferable.

The opening and closure means for said opening should not protrude above the surface of the plate. This is important to prevent any interference when containing devices are stacked upon one another. One embodiment of a closure configuration would be for the hole in the plate to be threaded to receive a thread disk closure. The closure can be adapted with an Allen head. Other type closure means are also contempleted which may be employed to close openings which are recessed below the plate surface.

When recessed surfaces are present in the upper plate, the opening may be present in the recessed surface.

Figure 4:
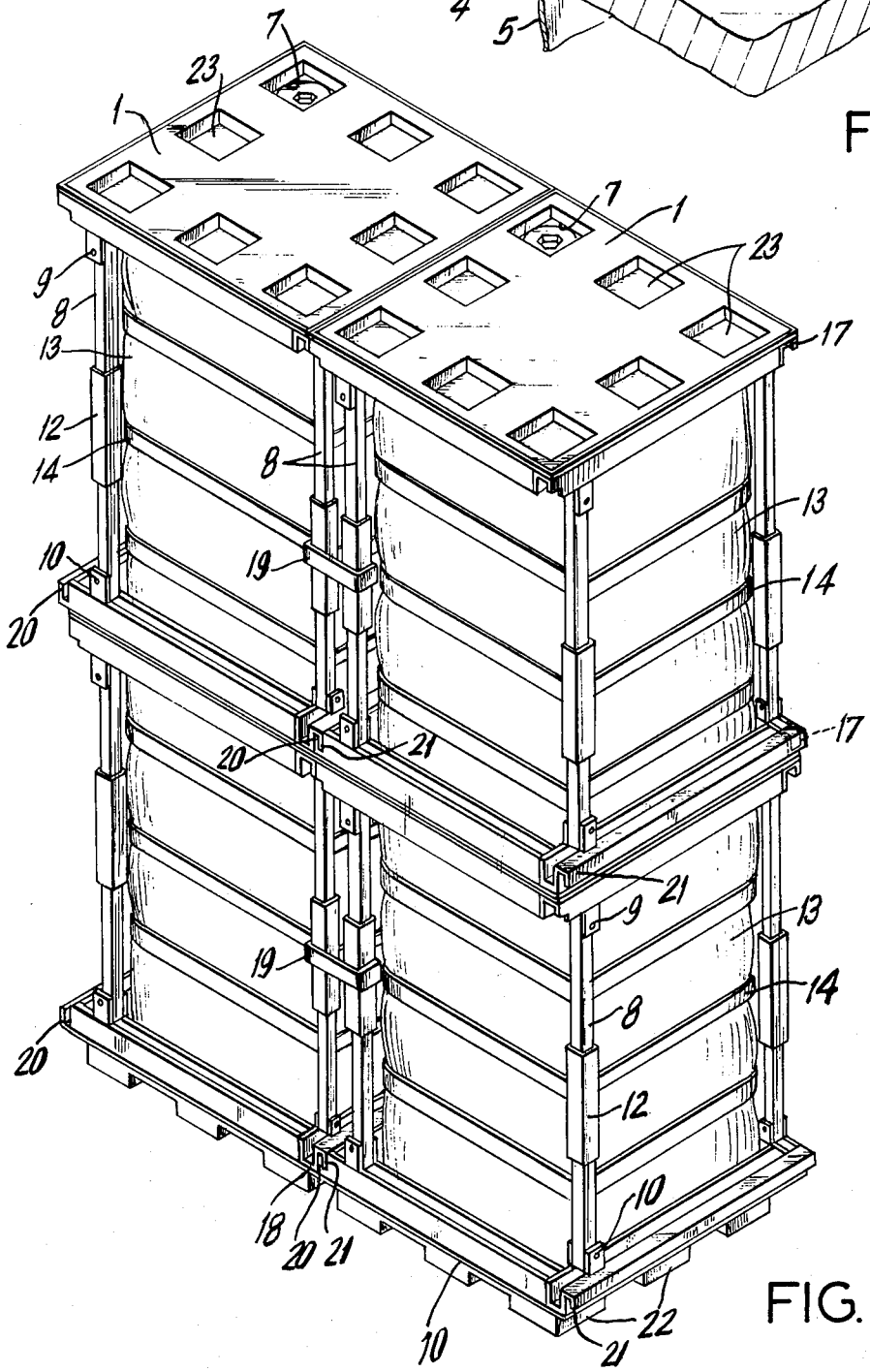
FIG. 4 is a perspective view of four containing devices of the present invention interlocked and stacked with one another for shipping or storage as a unit.

FIG. 4 illustrates one embodiment where the plates of the containing device are adapted with grooves 18 which enables one device to be detachably connected or interlocked to an adjacent device either at its side or stacked above of below.

To detachably connect adjacent containing devices, the base plates may be adapted with interlocking grooves. An example of one embodiment is illustrated in FIG. 4. The lip 21 of one side of the base plate 10 of one device fits into channel 20 in the side of the base plate of an adjacent device.

To further lock or fix adjacent containing devices to one another, elbow clamps 19 may be used to embrace the legs of adjacent containers.

Alternatively, each container device may be mounted onto a rack or shelf which may be located in warehouse facilities or on a carrier specifically adapted to interlock with the grooves on the upper and/or lower plates of each containing device.

Another feature is the base pallet illustrated in FIGS. 2 and 4. The base pallet comprises a plurality of protuberances or projections 22 on the bottom surface of the base plate having a conventional configuration for receiving the fork prongs used in mechanical moving equipment. When stacking the container devices, the upper plate 1 may be adapted to have recesses 23 which correspond to the protuberances 22 of the base plate. The opening 7 can be located in the base of one of the recesses.

Where the upper and lower plates are not circular and the sides of the device form flat planes, such a container cannot be rolled along the ground on its sides. FIG. 1 illustrates another feature where transporting rings 15 may be attached to the plates of the device. Such rings may be detached when the container is at its destination location and the ring then reused for the next container to be moved. The upper and lower plates have special corners 17 available for receiving or fitting within the internal channel 24 of the detachable ring 15. By the presence of this corner protrusion on the upper and lower plates a ring may be connected to the plates which will form a new edge for which the container can roll along on its sides. The diameter of the ring may be increased by a joint means 16 allowing the ring to be removable from the corners 17.

The lip 21 and channel 22 configuration used for interlocking adjacent container devices may also function as the corner protrusion for anchoring the transporting ring.

The Flexible Bag or Sleeve Component

The flexible component 3 may be open at the top and bottom in the form of a sleeve or may be permanently sealed at the base to form a bag. In either form, the flexible component is directly attached to the upper and lower plates of the frame. The means of sealing the top and/or bottom of the flexible component may be included within either of the plates themselves such as is illustrated by the opening and closure 7 in the accompanying figures or as an integral part of the means of attaching the flexible component to the plates.

The flexible bag or sleeve component may be comprised of a single member or a plurality of members. Each member may include one or more layers of the same or different material. Where the flexible component is in a multimember configuration, the innermost member in direct contact with the cargo will be referred to hereinafter as the liner.

Generally, the flexible component must fulfill at least two functions. The first concerns the strength of the component to support and hold the cargo contained within its structure and to withstand internal as well as external stresses, abrasion and wear. The second function is one of impermeability and insulation of the contents or cargo from the environmental surroundings. Where the flexible component comprises more than one member, the innermost member, the liner, will be primarily responsible for the impermeability function and the other flexible member or members will be primarily responsible for the strength of the flexible component. The strength providing member will be referred to generally hereinafter as the flexible support member or members.

Figure 3:
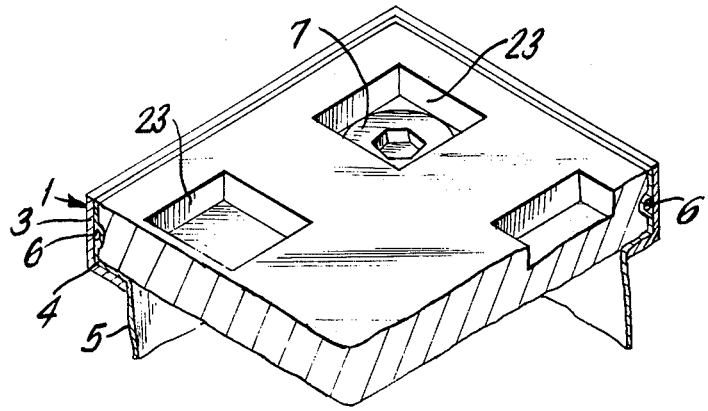
FIG. 3 is an enlarged, broken-away, perspective view of the upper plate of the containing device which illustrates one way of attaching the flexible containing means to the upper plate.

FIG. 3 illustrates in an enlarged broken away cross section a means of attaching the flexible sleeve component. The upper plate 1 is provided with a neck 3 molded integrally to the face of each plate directed toward the inside of the containing device. The outer sides of the neck have a groove 4 for receiving the terminal ends of the flexible component 5 and an anchoring ring 6 to affix the flexible component to the neck. In the case where the flexible component is in the form of bag, this type of construction would be suitable only for the upper plate.

In another embodiment of the present invention, the flexible component is permanently affixed to a mounting plate which mounting plate is directly attached to the upper and/or lower plates of the support frame.

Other means of attaching the flexible support member to the upper and lower plates of the support frame are well known in the art and are contempleted within the scope of the present invention.

The shape of the flexible support member should be chosen to conform with the shape of the upper and lower plates of the frame or at least to conform with the means of attachments contained within the upper and lower plates. For example, if the upper and lower plates are circular in shape, the flexible support component should be cylindrical. The shape of the flexible support component may conform to the shape of the neck 3 as described above.

The flexible support member is generally provided in the form of a tube having the desired cross-sectional dimensions and shape. The length of that tube of the flexible member component is defined by the distance between the upper and lower plates of the support frame which will in turn define the volumetric capacity of the collapsible containing device. As indicated above, where the leg members of the frame are adjustable, different capacity devices can be obtained by merely securing the flexible support component to the plates of the frame at suitable points along the length of the tube of fabric or sheet so that when the leg members are in the locked position the fabric or sheet will be taut.

The flexible support member may be composed of any one or more of a member of known flexible sheet or fabric materials which are capable of providing the properties and characteristics required in the device of the present invention.

The strength property of the flexible support member is a vital feature to the operation of the present invention. It is the combined ability of strength of the flexible support member with the frame which yields the great advantages achieved by the present invention.

One important property of the fabric or sheet material is that it not be susceptible to stretching when in use. Termed differently, it requires the flexible support member formed by the fabric or sheet to be volumetrically constant and stable. The flexible support member should remain taut between the upper and lower plates. This is a particularly important property when the containing device is to carry flowable cargo such as a liquid or aggregate solid material.

Flowable cargo has a tendency to flow or move within the container which can cause bulging depending upon the attitude of the container with respect to the ground. For example, where the containing device is placed on its side, there is a tendency for the device to bulge at the points farthest away from the points of attachment of the flexible support member to the frame. This bulging may be due to a stretching of the fabric or sheet or in the case of a woven fabric the tendency of the individual thread filaments to move with respect to each other. Therefore, in a woven fabric material, this property is dependent upon both the linear tensile strenght and inelasticity of the individual strands or threads making up the fabric, in addition to the density and "give" of the weave.

Some fabric or sheet materials have a capability of not bulging even when carrying large quantities of liquid cargo. However, other sheets or fabrics which normally would bulge may be constructed into the form of the flexible support member to overcome this problem. For example, as illustrated in FIGS. 1 and 4, one or more reinforcement strips or tapes 14 may be mounted on to the fabric or sheet along the outside perimeter of the tubular body at suitable distances along the vertical axis. FIG. 1 illustrates an empty containing device where the outer sides of the flexible support member are not vertical but slightly sloped toward the center of the container. FIG. 4 depicts containing devices which are filled and whose flexible outer sides are relatively vertical, taut and with surfaces formed by the leg members.

These strips or tapes 14 may be sewn into the fabric or may be attached to the outer surface of the fabric or sheet by any known technique. Bulge in the flexible support member may also be reduced or eliminated by mounting ears onto the outside surface of the flexible support member. The leg members of the frame can then pass through or be anchored to these ears and further prevent the bulging of the flexible support means. Bulging should be sufficiently prevented so that the flexible support member does not extend beyond the leg members or flat surfaces formed by interconnecting the leg members.

The strength of the fabric or sheet material in addition to its shape stability discussed above must include resistance to the various mechanical abrasions which are incident to the use of the containing device in bulk transport systems. For example, the sheet or fabric must be resistant to piercing and friction or rubbing. Moreover, the flexible support member must have crease resistance so that the folding and unfolding when the device is collapsed or expanded will not weaken the strength of the fabric or sheet.

Other properties for the flexible support member may include fire resistance or self-extinguishment from fire in addition to temperature resistance. Fabrics and sheets of material have the ability to be more capable of receiving specialized properties than that which is normally achieved in simple coatings onto metal barrels or tanks. For example, rust resistance is not a problem with such fabrics or sheets. Therefore, the containing devices of the present invention may be stored under water or in the presence of tremendous quantities of moisture and humidity for long periods of time without any danger of leakage due to deterioration of the containing means.

In the case of a single member flexible component, the flexible support member has sufficient impermeability properties for the cargo to be contained. This may be achieved by chemically treating the flexible support member.

The flexible component may be composed of various different materials depending upon the type of cargo it is to contain and the actual properties which are required of it. The flexible support member may, for example, be of a woven or non-woven fabric or sheet. When in the form of a non-woven fabric or sheet, it may be knitted or extruded. The important feature with respect to the flexibility of the fabric or sheet is that it be sufficiently flexible to collapse within the framework of the containing device when the frame is in the collapsed and compact position.

One particular material which has been found exceptionally suitable in a flexible support component in accordance with the present invention are woven fabrics made of Kevlar yarn. Kevlar is an aromatic polyamide manufactured by E. I. duPont de Nemours & Company. Kevlar, in the form of yarn, has a high tensile strength and low elasticity which is lightweight and has excellent toughness. Kevlar 29 is a yarn which is readily woven and has been used as a ballistic fabric as well as in parachutes, inflatable boats and safety clothing.

Kevlar 29 is available in a wide range of deniers and weaves which are suitable as a flexible support material in the present invention. For example, 55 gallon containing devices have been made in accordance with the present invention by using a 2-ply Kevlar 29 yarn. This Kevlar 29 woven fabric comprises 2-ply untextured yarn wherein each ply has a denier/thread count of 400/267 and where the yarn is formed of 3 turns or twists of the two plies per inch in the "Z" direction. The yarn is woven to yield a 1 × 1 plain weave having a yarn count of 36 warp, 36 fill. Kevlar 29 can be coated and/or impregnated to increase its chemical resistance although it has good resistance to solvent, fuels and lubricants. Because Kevlar is subject to degradation under various wavelengths of light, the outer surface is usually coated to protect it.

Other materials such as various nylon fabrics may be used to form woven flexible support components in accordance with the present invention although such other materials may not have the tensile strength of Kevlar.

Non-woven materials suitable in the flexible support component include knitted fabrics and extruded plastics.

The actual construction of the flexible support member is not critical. For example, the flexible support member may be seamless yet still be woven or non-woven. A woven seamless tubular fabric may be made, for example, by weaving the fabric on a tubular-type loom. Other seamless fabrics may be made by extruding a fabric or sheet or by knitting it. However, the presence or absence of a seam is not important to the operation of the present invention so long as any seams that are present do not weaken or detrimentally effect the characteristics of the rest of the material. For example, the seams must be at least as strong as the rest of the material. Moreover, if the rest of the material is treated for impermeability the seams must be equally treated.

The seams may be suitably treated to obtain the above-noted properties by any one of numerous techniques. Such techniques include sewing, cementing, electronically bonding, welding or vulcanization, strapping seams, or by a combination of processes including, for example, a sewing and sealing technique. All of these techniques are well known in the textile industry.

As noted above, the flexible component may include a liner which can be impermeable, not permitting through passage of the cargo to the flexible support member. Therefore, when such a liner is used, the flexible support member need not be impervious or impermeable to the cargo. In some cases, resistance to chemicals cannot be simply obtained with the flexible support member by conventional means of coating and impregnation yet still retain the required strength. Therefore, in such cases, it is often more economical to utilize an insert liner or bag within the flexible support member.

A liner may also be present as the second member of the flexible bag or sleeve component whose purpose is to supplement, compliment or insure various characteristics or properties of the flexible support component. For example, by the use of special liners, the collapsible containing device may be adapted to contain even the most corrosive and reactive chemicals. The liner may be disposable as it is usually lower in cost as compared to the support member. The liner may be reused after cleaning. Generally, it will be more economical to clean the liner as compared with the flexible support member itself. By use of an insert liner the same collapsible containing device can be used for many different cargoes. In addition, special properties such as very extreme temperature insulation can be obtained by merely adding a special liner to the container.

The fabric or sheet used for either the liner or the flexible support member may be single layer or multilayer. For example, the fabric or sheet may be quilted or may be laminated.

The liner need only be attached or anchored to the containing device at the upper plate. Where the liner is used the entire sealing means for the cargo may be contained within the liner and no separate sealing means may be required for the flexible support member. In the case of highly corrosive, volatile chemicals, fo example, it may be desirable to seal the cargo both with the inner liner and by means of the flexible support member and/or upper plate.

The flexible support member can also be provided with means for insuring that it fully collapses within the frame as the leg members move from the locked to the collapsed or closed position. This capability can be obtained by adding an elastic strip to the flexible support member so that when the vertical stress is removed by closing the vertical leg members, the elastic will reduce the cross section of the flexible support member by giving it the tendency to come together toward the center of the device. The elastic strip may coincide with or be present in lieu of the reinforcement strips 14.

What is claimed is:

1. A collapsible containing device for containing both liquid and solid cargoes, said device comprising:

a flexible component as the primary containing means which is in the form of a bag or sleeve attached at its upper and lower extremities to the upper and lower plates of a collapsible supporting frame;

a collapsible supporting frame comprising an upper rigid plate having an opening therein with closure means for filling and emptying the containing device and a lower rigid plate, said plates are attached to each other by collapsible leg members fixedly secured along the perimeter of each of said plates by hinge means which enable said leg members to have an open or extended position and a closed position, wherein said leg members in the open or extended position are perpendicular to said plates and are sufficiently long to fixedly support the upper plate in elevated relation above the lower plate to enable the outer sides of said flexible component to be substantially vertical and taut when the device is filled with cargo, and wherein in the closed or collapsed position the leg members reduce in length so that the upper and lower plates become substantially adjacent to one another and wherein the flexible component collapses toward the three-dimensional center of the containing device;

said containing device characterized as having sufficient strength and endurance to be used in both manual and mechanized transporting systems and where said device efficiently utilizes storage and carrier space when full with cargo and is capable of collapsing when empty to a compact configuration which is significantly smaller in volumetric size than its open configuration.

2. The collapsible containing device of claim 1 wherein said upper plate and/or said base plate is provided with a neck member directed toward the inside of the containing device, said outer sides of the neck member having a groove for receiving the terminal ends of the flexible component and an anchoring member for suitably affixing said flexible component to said neck.

3. The collapsible containing device of claim 2 wherein said flexible component comprises a flexible woven seamless material in the form of a tube or sleeve which is volumetrically stable and which is affixed to neck members on said upper and lower plates.

4. The collapsible containing device of claim 1 wherein the flexible component is in the form of a sleeve wherein the open terminal ends of said flexible component is attached to said upper and lower plates.

5. The collapsible containing device of claim 4 wherein said flexible component comprises at least two members, one of which is an internal liner sufficiently impermeable and impervious to passage of the cargo to a second outer member which is characterized as being durable and strong.

6. The collapsible containing device of claim 1 wherein the surface dimensions of said upper and lower plates are not circular and wherein said upper and lower plates are adapted to receive a detachable transporting ring, said ring capable of detachably connecting to the corners of said upper and lower plates.

7. The collapsible containing device of claim 6, wherein said detachable ring has means of changing its diameter to an open, larger diameter position and a locked or smaller diameter position and wherein said detachable ring contains an internal channel which interconnects with the corners of said upper and lower plates when said ring is in the locked position.

8. The collapsible containing device of claim 6 wherein the upper and lower plates are of square dimensions.

9. The collapsible containing device of claim 1 wherein the bottom surface of said base plate is a pallet comprising a plurality of projections having a suitable configuration for receiving forked prongs used in mechanical moving equipment.

10. The collapsible containing device of claim 9 adapted to be stacked vertically wherein the upper plate contains a plurality of recesses which correspond to the projections in the bottom surface of said base plate.

11. The collapsible containing device of claim 1 wherein the lateral edges of said base plate are adapted with interlocking lips and channels with are capable of detachably interlocking the base plate of one containing device with one or more other containing devices.

12. The collapsible containing device of claim 11 wherein removable elbow clamps are attached to said vertical leg members which are capable of embracing adjacent leg members of containing devices positioned side-by-side.

13. The collapsible containing device of claim 1 wherein said flexible component contains one or more reinforcement strips mounted on the outside perimeter of said flexible component to maintain the substantially vertical and straight outer surface of the flexible component when the device is filled with cargo.

14. The collapsible containing device of claim 1 wherein the flexible component has affixed thereto an elastic strip around its outside perimeter capable of causing said flexible component to converge toward the center of said device when said leg members are collapsed.

15. The collapsible containing device of claim 1 wherein said flexible component comprises a Kevlar non-texturized woven fabric suitably treated to be resistant to deterioration by radiation.

16. The collapsible containing device of claim 6 wherein each of said collapsible leg members comprises two pieces connected by a hinge located at a point along each leg member between said plates, which hinge enables each leg member in collapsed position to be folded into two pieces and in extended position to be in substantially straight configuration, wherein said hinge is adapted with a removable lock sleeve which when covering said hinge immobilizes it in locking each leg member in extended or open position.

* * * * *